US005497895A

United States Patent [19]

Rudbach

[11] Patent Number: 5,497,895

[45] Date of Patent: Mar. 12, 1996

[54] TRANSPORT CONTAINER

[75] Inventor: Michael Rudbach, Biwer, Luxembourg

[73] Assignee: Euro-Composites S.A., Echternach, Luxembourg

[21] Appl. No.: 318,805

[22] PCT Filed: Feb. 17, 1994

[86] PCT No.: PCT/EP94/00456

§ 371 Date: Dec. 20, 1994

§ 102(e) Date: Dec. 20, 1994

[87] PCT Pub. No.: WO94/19261

PCT Pub. Date: Sep. 1, 1994

[30] Foreign Application Priority Data

Feb. 17, 1993 [DE] Germany ..... 43 04 845.5

[51] Int. Cl.[6] ..... B65D 90/04

[52] U.S. Cl. ..... 220/4.33; 220/440; 220/442; 220/669; 220/670

[58] Field of Search ..... 220/4.33, 440, 220/442, 669, 620

[56] References Cited

U.S. PATENT DOCUMENTS

| | | | |
|---|---|---|---|
| 2,100,895 | 11/1937 | Austin | 220/442 |
| 2,958,442 | 11/1960 | Lorentzen | 220/442 |
| 3,510,278 | 5/1970 | Alleaume | 220/442 |
| 4,266,670 | 5/1981 | Mykleby . | |
| 4,366,917 | 1/1983 | Kotcharian | 220/442 |

FOREIGN PATENT DOCUMENTS

| | | |
|---|---|---|
| 0029229 | 5/1981 | European Pat. Off. . |
| 0212097 | 3/1987 | European Pat. Off. . |
| 0271118 | 6/1988 | European Pat. Off. . |
| 2624483 | 6/1989 | France . |
| 1049784 | 7/1959 | Germany . |
| 7821056 | 11/1978 | Germany . |
| 3043607 | 6/1981 | Germany . |
| 85268380 | 3/1987 | Germany . |
| 3838153 | 5/1990 | Germany . |
| 4118857 | 12/1992 | Germany . |
| 89011422 | 11/1989 | WIPO . |

*Primary Examiner*—Joseph M. Moy
*Attorney, Agent, or Firm*—Rothwell, Figg, Ernst & Kurz

[57] ABSTRACT

Transport containers are known that comprise walls (10, 10'; 12) and a floor (11). The side walls (10, 10') are connected to one another by frame parts (20). The walls (10) of these containers are made of plywood, chipboard or sheet metal. A considerable enhancement of shock resistance, in particular resistance to damage by sharp-edged objects, can be achieved by constructing the walls (10, 10', 12) of sandwich panels comprising two outer face layers and a honeycomb core connecting them, such that the cells of the honeycomb extend perpendicular to the face layers.

19 Claims, 11 Drawing Sheets

Figure 1:
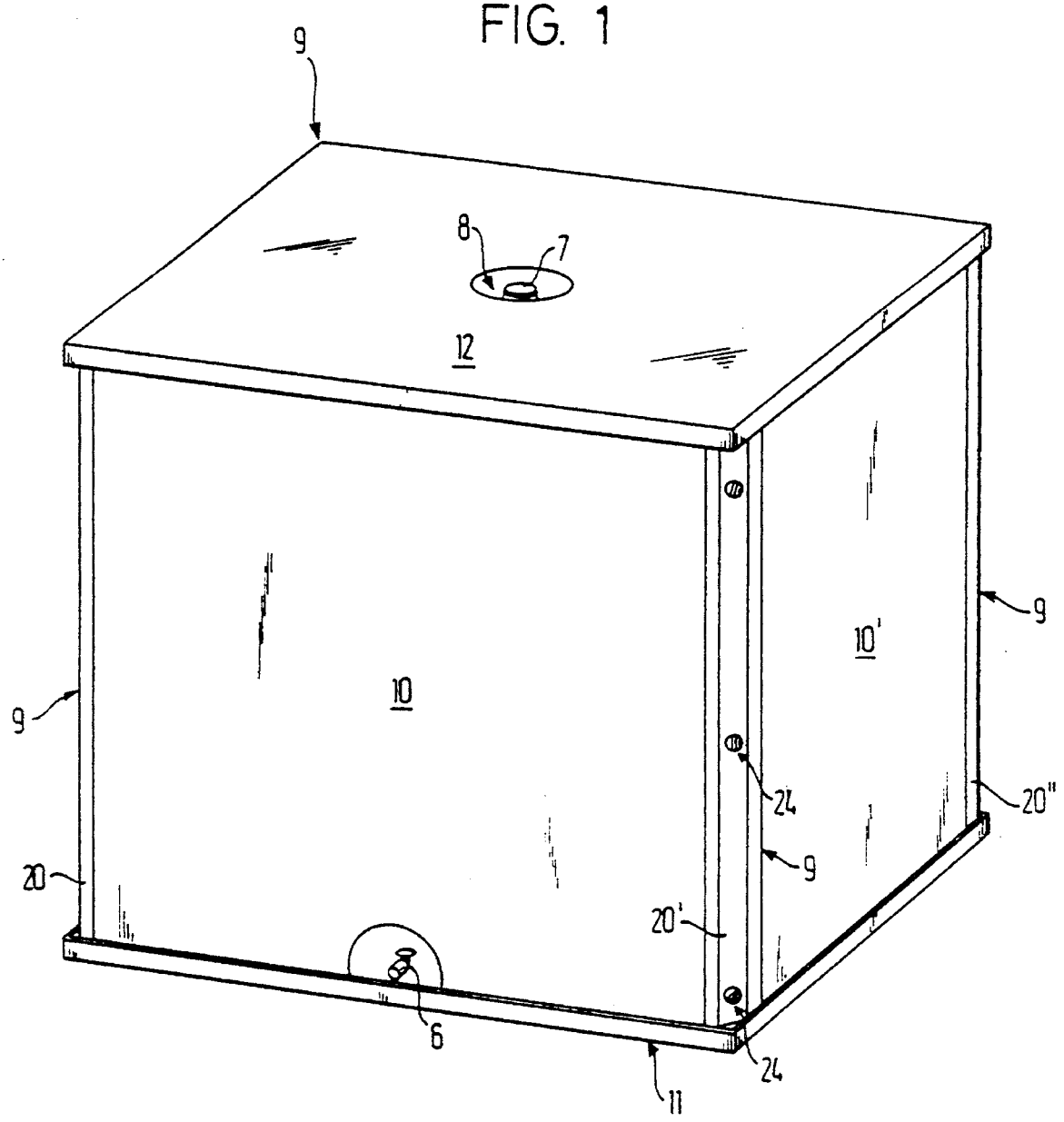

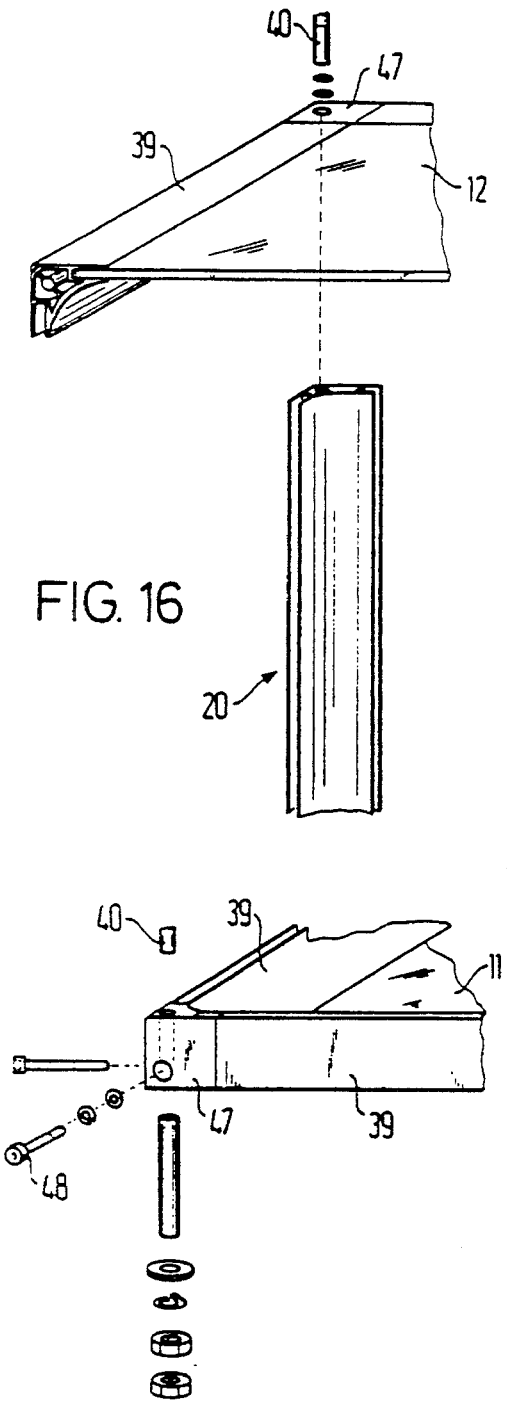
FIG. 16
FIG. 17
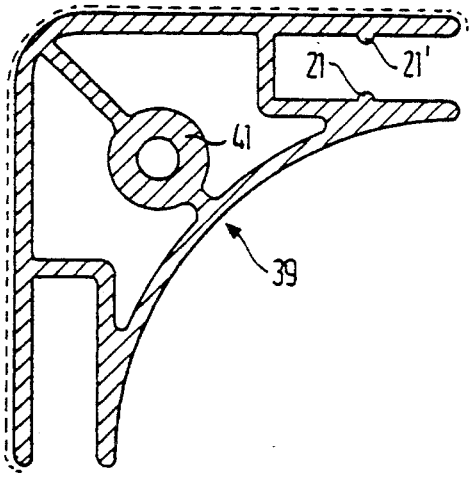
FIG. 18
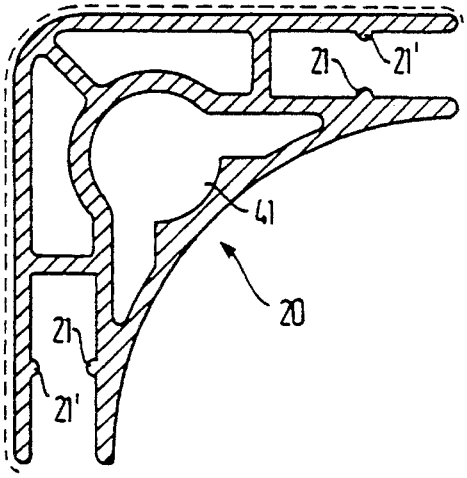
FIG. 19
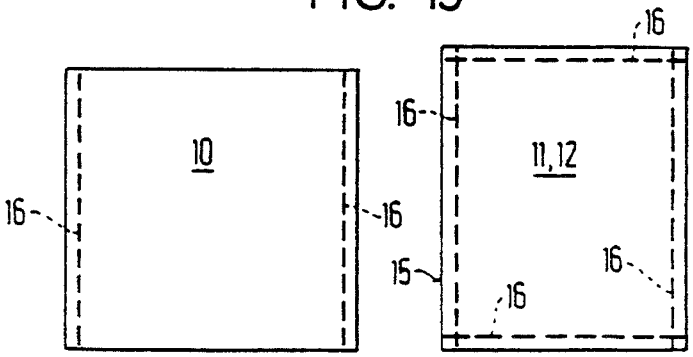

TRANSPORT CONTAINER

DESCRIPTION

The invention relates to a transport container in cuboid form according to the precharacterizing clause of claim 1.

Such transport containers, in particular in the form of pallet containers, are used to send goods and after being emptied are to be returned to the sender for refilling. These transport containers must thus be lightweight and nevertheless have long-term stability. The stability requirements are especially high when the contents of the container are vulnerable to shock and impact. This applies to an even greater extent when dangerous fluids are to be transported. Then the transport container is required to protect an inner container (usually made of plastic) in its interior from damage.

Such a transport container has been disclosed in Wo 89/11 422. This transport container is collapsible. The walls of this known transport container are made of plywood. DE-AS 1 049 784 discloses a transport container of the same kind, the walls of which consist of hardboard. Another transport container of this kind is disclosed in EP 29 229 A1, wherein the walls are to be "lightweight panels" the construction of which is not described, which are intended to ensure a stable but nevertheless lightweight structure owing to a particular design of frame components.

The known transport containers present the problem that although their weight is relatively high, the walls are insufficiently strong and, in particular, can break apart under impact.

DE 41 18 857 A1 discloses a container that consists of individual boxes nested one inside another. This transport container is extremely elaborate and also heavy.

G 85 26 838 U1 discloses a collapsible container, the frame parts of which are designed as outwardly projecting members, U-shaped in cross section, to receive panels of plywood or cardboard. One such member of all floor and cover frames includes an inwardly projecting ridge designed to press into the panel material when the cover and floor are in place. The cover and the floor, each consisting of a panel and a frame enclosing the periphery of the panel, are not intended to be taken apart; only the four side walls of the container are to be inserted between the members of the vertical frame parts, which are not provided with such ridges, so as to allow elastic torsion of the container within certain limits. A transport container of this kind, however, is not suitable for receiving bulk material or plastic containers (liners) to hold fluids, because the hydrostatic pressure will cause the container to burst due to the inadequate connection between side panels and side frame parts, unless the frame parts are made extremely stable and hence heavy, or are joined together by other means.

The present invention is directed to the problem of developing a collapsible transport container of the kind described above in such a way that high, long-term stability can be attained with simple construction.

This problem is solved by a transport container according to claim 1. A method of manufacturing the transport container is given in claim 15.

By fabricating the walls of sandwich panels (known per se) with a honeycomb core, surprising advantages are achieved. The sandwich panels have been found to sustain quite considerable impacts and shocks, or to convert these impulses into energy of deformation of the honeycomb core, without breaking apart, so that the contents of the transport container remain undamaged. If there is an impact on such a transport container, it exhibits local, external deformation but can nevertheless continue to be used. The probability that exactly the same place will be struck again, so that the transport container breaks owing to a lack of damping capacity at this place, is extremely small. An extension of the deformation such as can occur, for example, when simple sheet metal panels are used, is excluded in the case of these sandwich panels.

The walls are form-fitted to the frame parts. For this purpose grooves are recessed into the walls parallel to their edges, into which are inserted ridges of corresponding shape formed integral with the frame parts. The grooves in the two face layers are preferably disposed opposite one another, so that the ridges can lock into them symmetrically and thus provide symmetrical force relationships.

The grooves are preferably formed without the removal of material, by plastic deformation of the face layers and the honeycomb core. The grooves are so shaped that there is little stress concentration. Hence the connection between the walls and the frame parts strongly resists being pulled apart, so that the transport container can sustain large forces tending to expand it. Furthermore, fabrication is thus made particularly simple.

The frame parts are preferably so constructed that each individual frame part connects two walls to one another and forms an edge of the transport container. The number of frame parts is thereby minimized.

In a first embodiment, each frame part connecting two walls comprises an inner and an outer section, held together by clamp devices acting perpendicular to the long axes of the sections, in such a way that the walls are clamped between the frame sections by their edges, with the ridges engaged in the grooves. Assembly is thus extremely simple. In addition, the transport container can be completely taken apart, so that the walls can be handled separately from the frame parts. Collapsed in this way, the transport containers can easily be returned to the sender. Even if the transport containers are quite large, because all the individual components are separable a single person can assemble or disassemble them although the frame parts may be very massive. This represents a further substantial difference between the present transport container and the previously known arrangements.

The outer and inner frame sections for each edge are preferably captively joined to one another, which simplifies both assembly and disassembly of the transport containers. The clamp devices are preferably constructed as quick-acting closures comprising a tension lever or the like that can be operated without a tool. Ordinary screw devices can of course also be used.

In another preferred embodiment of the invention the frame parts are constructed in one piece, and the distance between their members with the ridges, into which the walls are inserted, is made such that it is possible to push the walls into the frame parts in the long direction of the latter.

The frame parts can be manufactured particularly inexpensively and also with sufficient stability by the extrusion method.

The floor and a top wall are preferably provided with cover frame parts, which are connected to the adjoining walls by way of members without ridges. When the transport container is disassembled, the floor and the top wall are manipulated together with the cover frame parts, i.e. they form units with the latter. The vertical frame parts and the side walls of the transport container can be separated from one another. Preferably the top wall and the floor are connected to one another by way of tie bolts that pass through vertical frame parts. To guide these tie bolts, tubular elements are preferably provided in the vertical frame parts. This arrangement provides a particularly durable and close-fitting structure with high stability.

The outer face layers and the honeycomb core are preferably made of aluminum. This material provides especially good damping properties combined with low weight and high strength. For particularly demanding applications, one or both face layers can additionally be provided with a protective layer of material with high tensile strength, a particularly suitable material being a fiber-filled plastic laminated onto the face layers (or between face layer and core).

The cells of the honeycomb core at the edges of the walls are preferably filled with artificial resin or the like, so that even when handled roughly the edges will reliably resist deformation. This measure also reduces the risk of damage. Finally, filling of the cells at the edges ensures that the walls will be more resistant to pressure (perpendicular to their surfaces) in the region in which the frame parts are attached, so that the form-fitting engagement can be brought about or maintained with large pressing force.

The transport container can be used to receive not only general cargo but also bulk loads or liquids. For such contents, in the top wall there is preferably provided a feed opening that can be tightly closed by a screw cap. Through this feed opening, bulk material can be poured into the container and later removed from it.

If the transport container is to be used to receive liquids, an inner container (liner) is inserted, which is made for example of a sheet of material sufficiently resistant to tearing and is equipped with a sealing ring to form an access opening. The "bubble" thus formed is therefore closed except for this access opening, bounded by the sealing ring. This liner is now set into the transport container so that folds are eliminated as far as possible. The (elastic) sealing ring is pulled outward through the feed opening, undergoing some deformation in the process, and is set onto the feed opening, which for this purpose is provided with a seating surface shaped to match the outer contour of the sealing ring. After filling, the cap can be screwed onto the feed opening, the dimensions being such that the cap makes firm contact with the sealing ring and hence forms a leakproof closure of the inner container.

Particularly surprising advantages result when the transport container in accordance with the invention is used to receive an inner container made of plastic for the transport and storage of fluids, in particular dangerous (flammable or corrosive) liquids. When the characteristics of the transport container for liquid materials constructed in this way are compared with those of previously known transport containers, the surprising effect of the sandwich panels used for the walls becomes clearly apparent. For example, the sheet metal material of which the peripheral walls are made in the transport container disclosed in DE 90 02 099 U1 would have to be very thick and consist of high-grade steel in order to have the same resistance to impact (in particular impact by the edges of objects) as the transport container in accordance with the invention. This would of course increase the weight.

To manufacture the transport container, in particular the walls of this transport container, it is preferable to proceed in the following steps:

The slab of honeycomb core is produced, such that the cells extend perpendicular to the main surfaces of the slab; to each of the main surfaces of the honeycomb slab there is applied thermoplastic adhesive film in the form of a long sheet; sheets of face material are then applied to the thermoplastic adhesive films; the sheets of face material are heated until the thermoplastic adhesive film softens and reaches its adhesive temperature; the sheets of face material are pressed onto the honeycomb core and the face-layers are cooled until the adhesive film has solidified and the face layers are joined to the honeycomb core.

This process is preferably substantially continuous. In this case the adhesive film and/or the sheets of face material can be drawn from rolls. Instead of a separate adhesive film it is also possible to use for the face layers a material already provided with an adhesive film.

The heating and pressing operations preferably occur continuously by way of rollers or belts. A heated roller can be applied with suitably adjusted pressure so that the heating process is simultaneous with the pressing process.

The peripheral, resin-filled regions of the walls are produced by introducing the artificial resin into the cells before the face layers are permanently attached. If the sandwich panels for the walls are being manufactured continuously, this filling process can also be continuous. The side edges of the long honeycomb slab are filled, and linear regions perpendicular to the side edges are also filled with resin at intervals corresponding to the length of a side of the wall to be manufactured. Linear regions parallel to the edges can of course be filled as well, if the format of the wall to be manufactures requires it. After the face layers have been applied, the slab of material is cut or sawn to separate the individual walls, in such a way that the separation lines lie in the middle of the resin-filled regions.

The formation of the grooves is also a continuous process, wherein as the material is manufactured those grooves oriented parallel to the transport direction are pressed in by rollers while those perpendicular to the transport direction are produced by correspondingly revolving pressing implements such as cylinders bearing ridges. Preferred embodiments of the invention are described in the subordinate claims.

Figure 2:
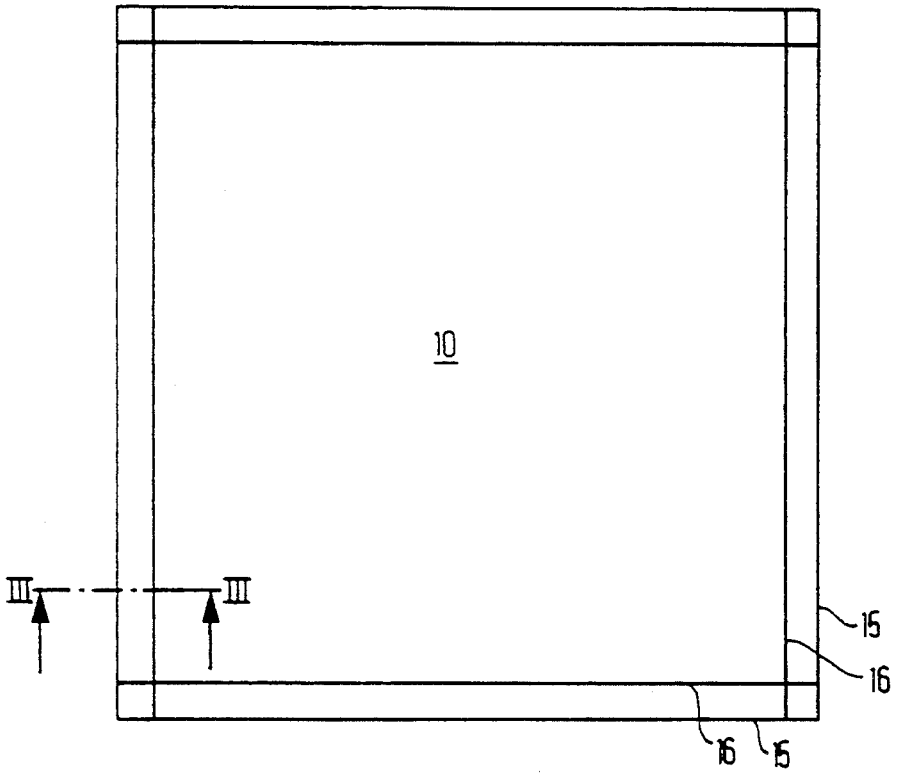
Figure 3:
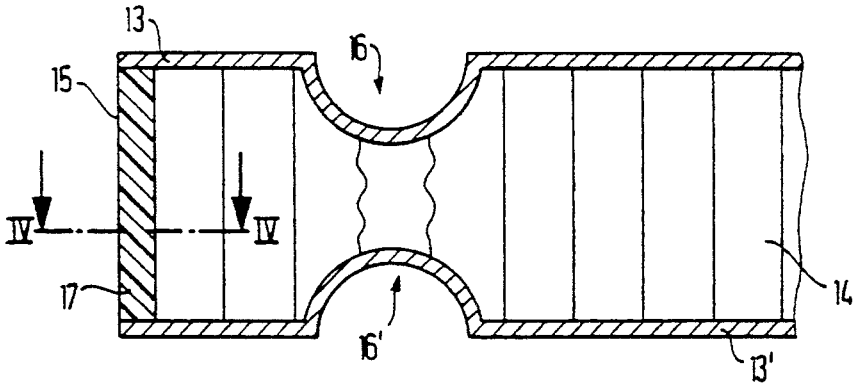
Figure 4:
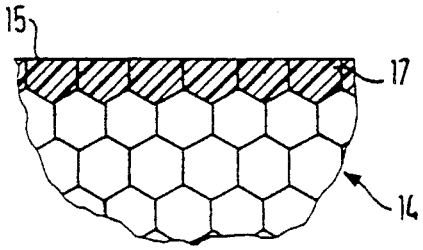
Figure 6:
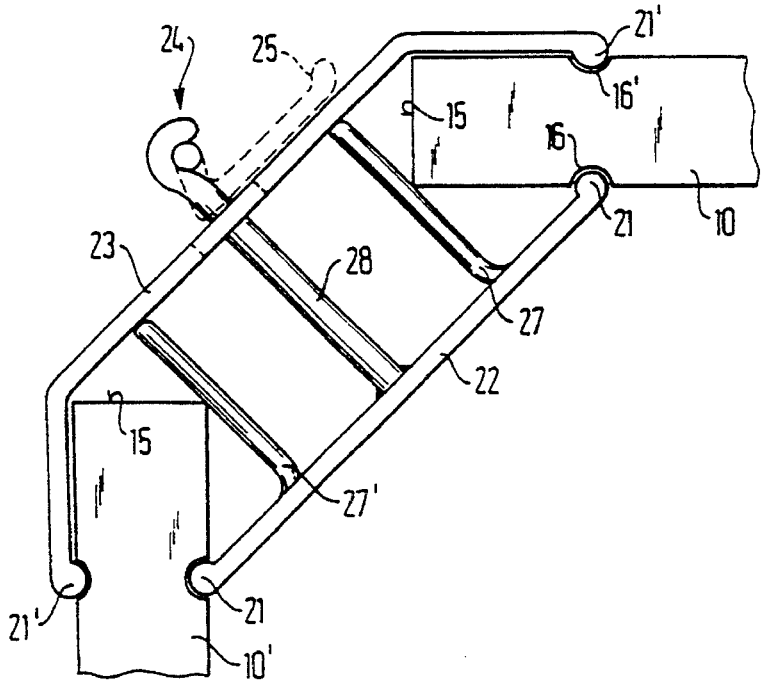
Figure 7:
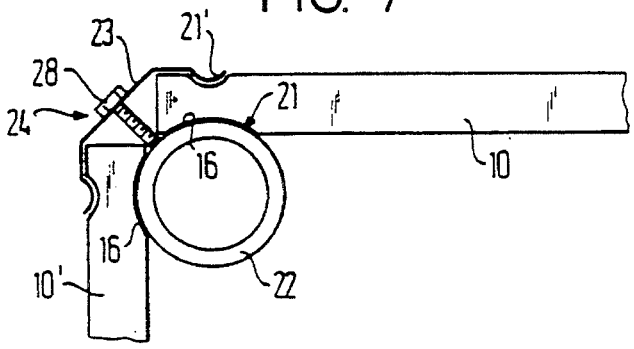
Figure 8:
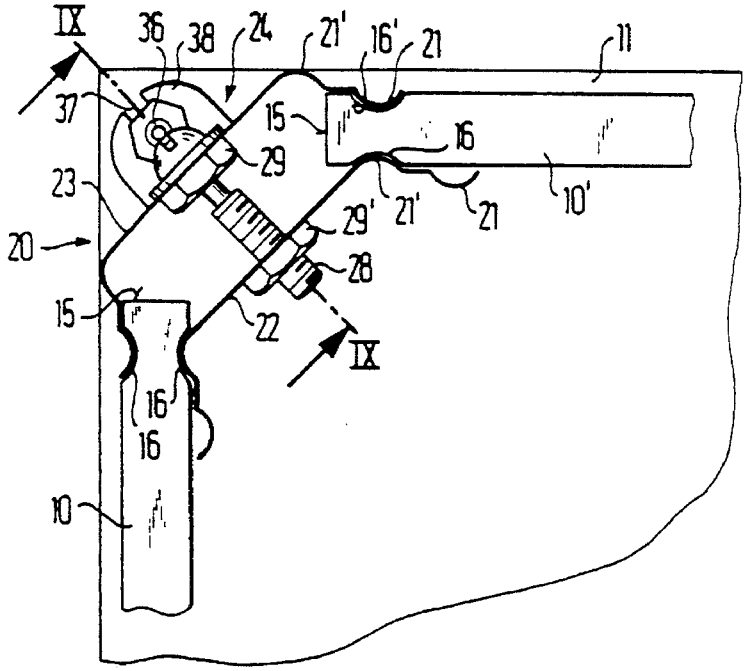
Figure 9:
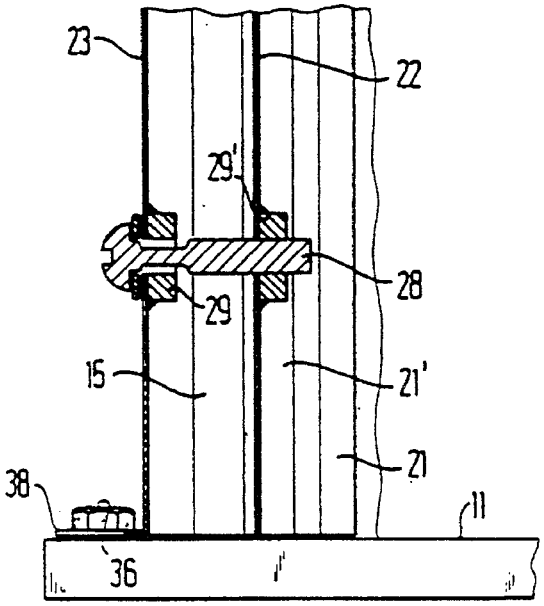
Figure 10:
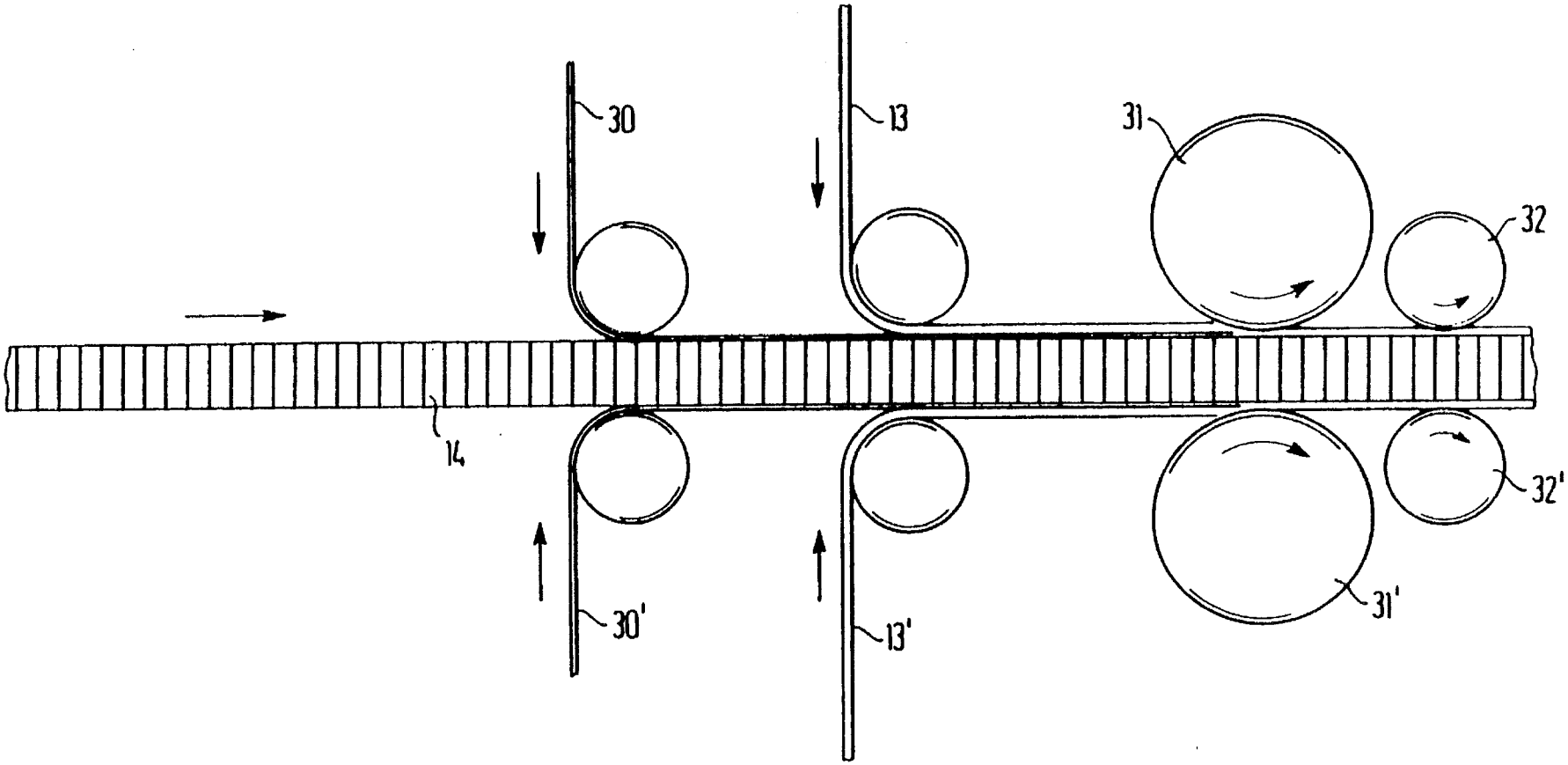
Figure 11:
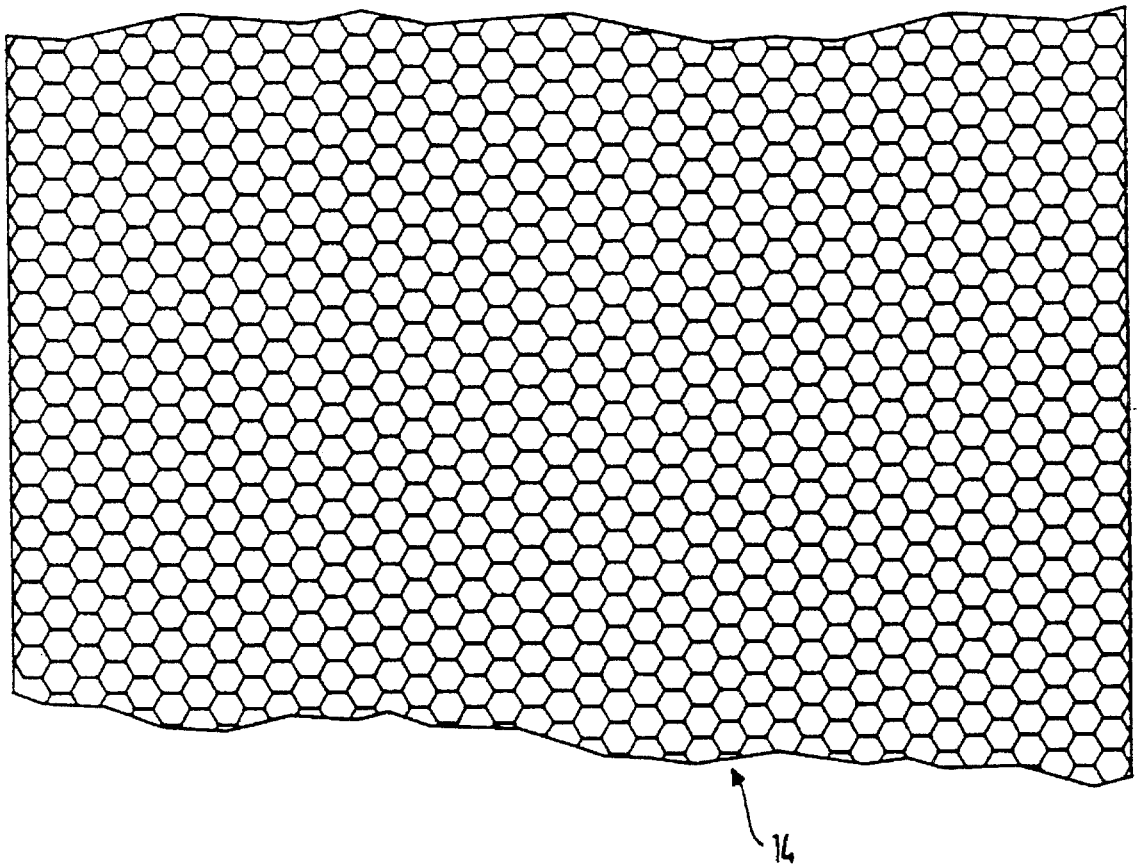
Figure 12:
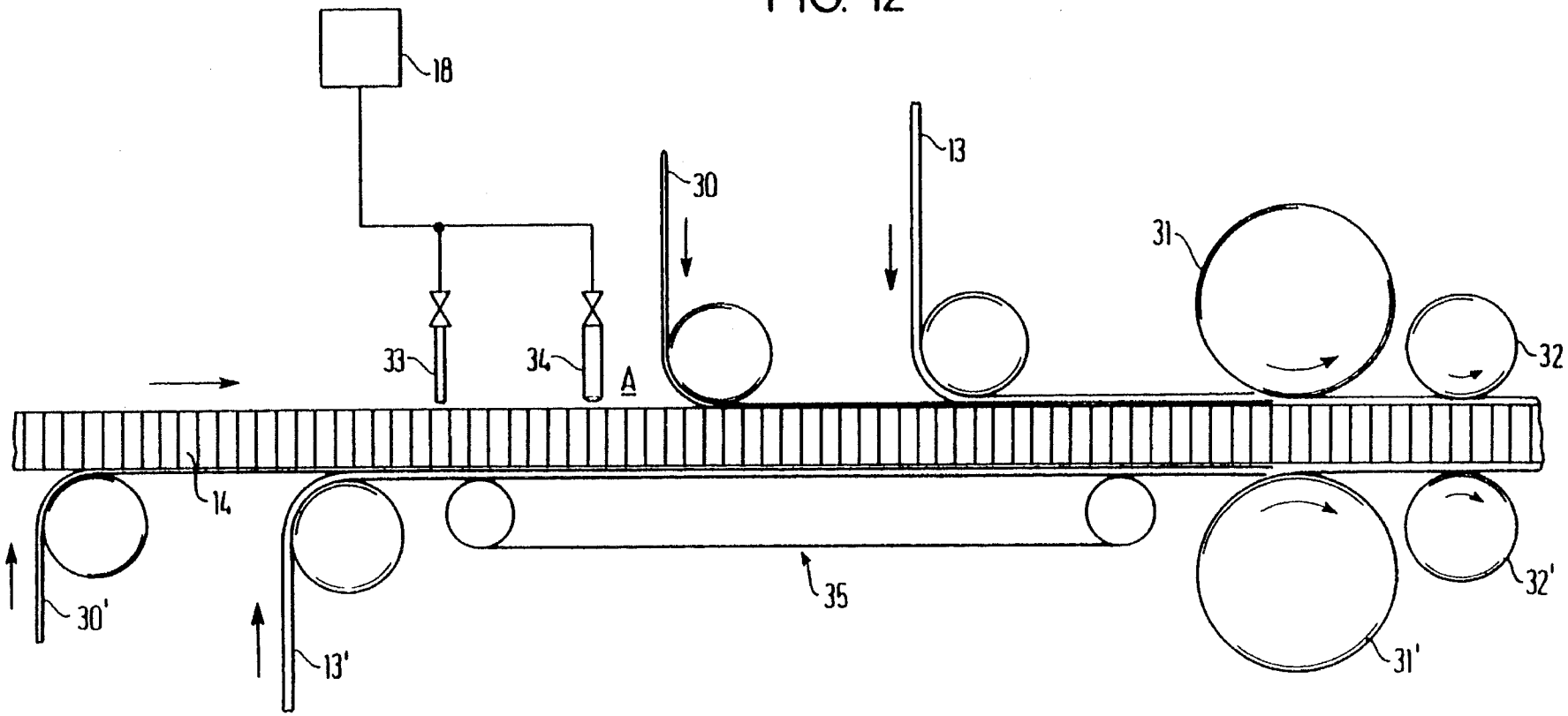
Figure 13:
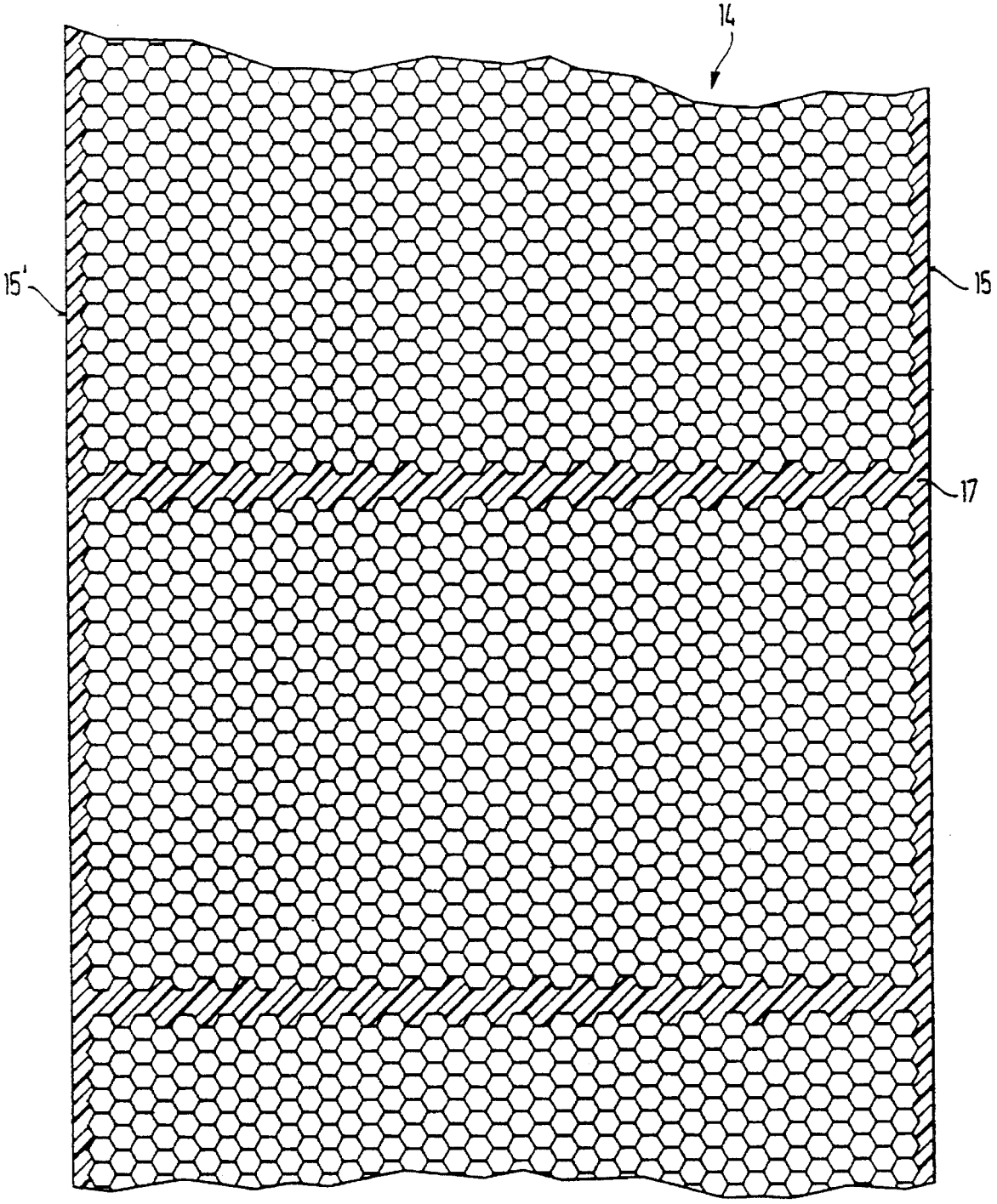
Figure 14:
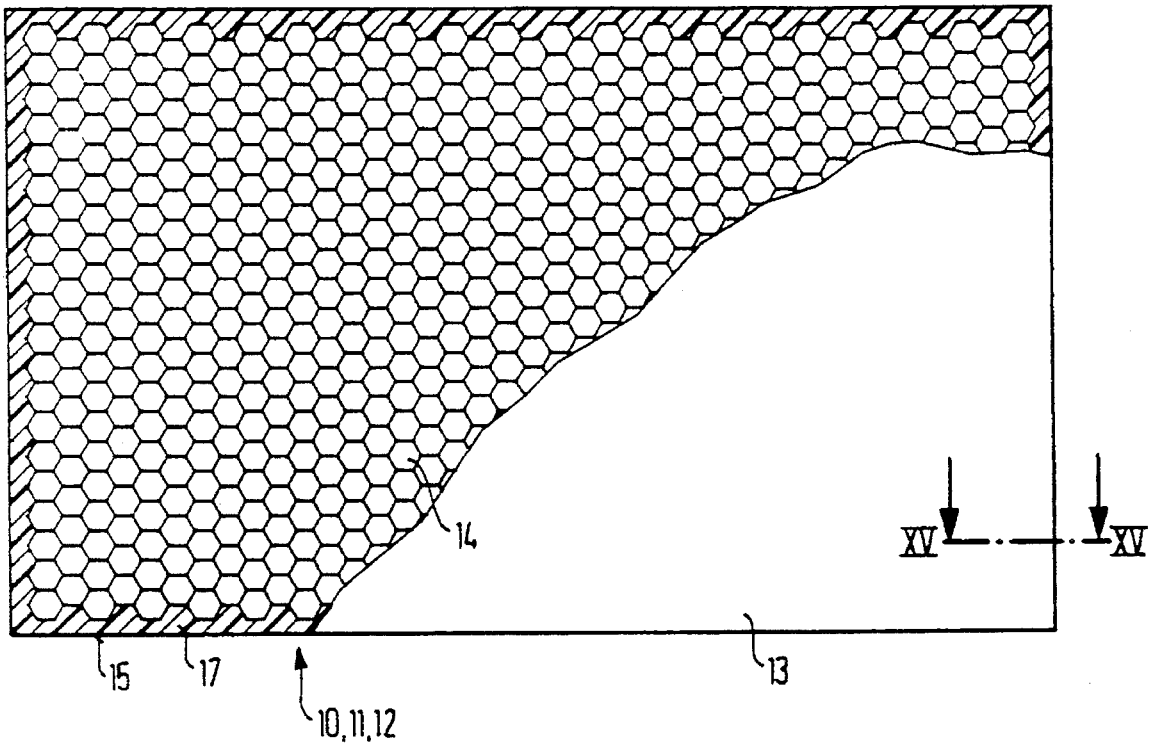
Figure 15:
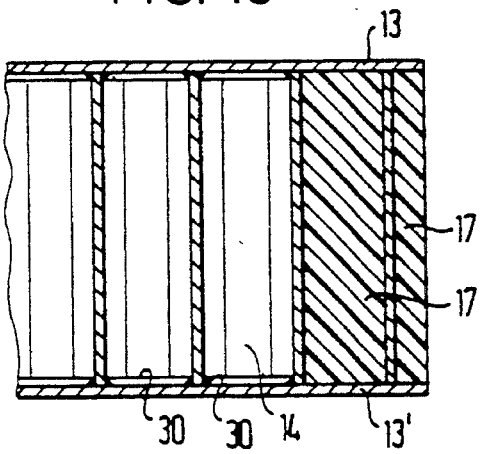
Figure 20:
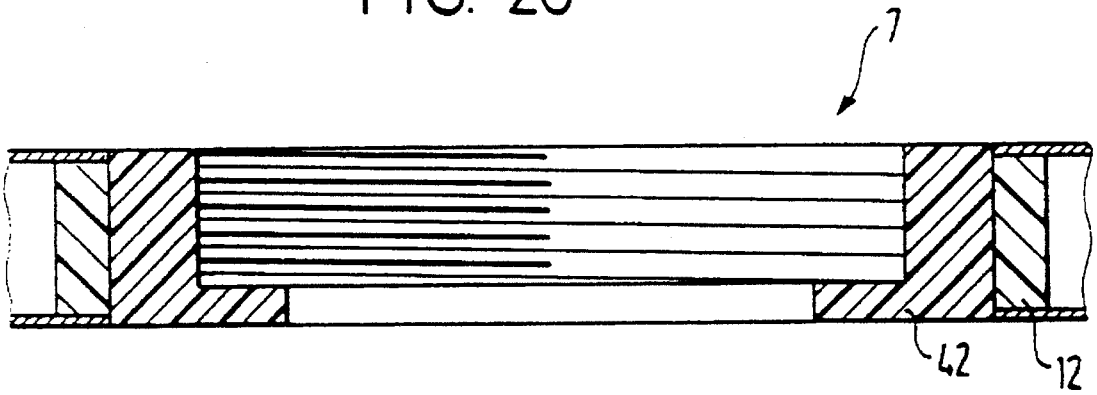
Figure 21:
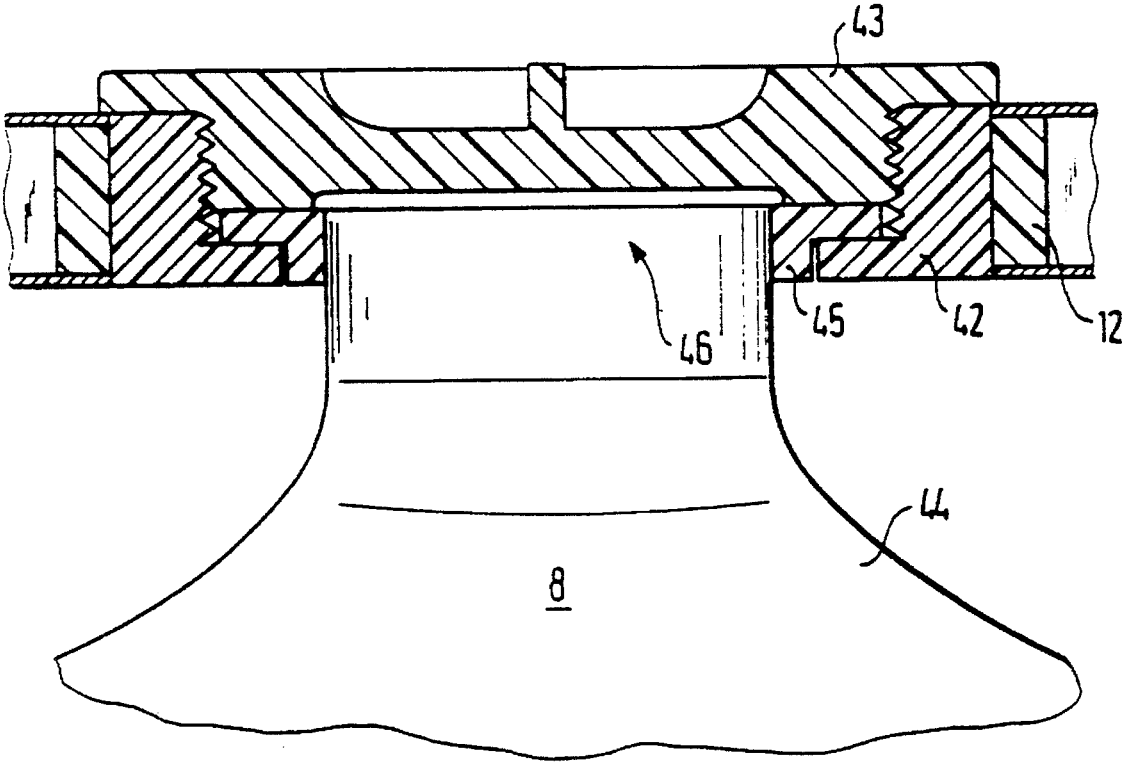

In the following, exemplary embodiments of the invention are described in detail with reference to drawings, wherein FIG. 1 is a perspective view of an assembled transport container with inner container inserted, FIG. 2 is a plan view of a wall, FIG. 3 shows a section along the line III—III in FIG. 2, FIG. 4 shows a section along the line IV—IV in FIG. 3, FIGS. 5–8 show fragmentary cross sections through frame parts in which walls are mounted, FIG. 9 shows a section along the line IX—IX in FIG. 8, FIG. 10 is a schematic drawing to illustrate the manufacture of wall material, FIG. 11 is a plan view of a honeycomb core, FIG. 12 shows another preferred embodiment of the manufacturing procedure, in a schematic drawing like that in FIG. 10, FIG. 13 is a plan view of the material in region A of FIG. 12, FIG. 14 is a plan view of a wall with face layer partly removed, FIG. 15 shows a section along the line XV—XV in FIG. 14, FIG. 16 is a partially exploded perspective view of another embodiment of the transport container, FIG. 17 shows a cover frame part in cross section, FIG. 18 shows a side-edge frame part in cross section, FIG. 19 shows a side wall (left) and a floor or a top wall (right), FIG. 20 shows a vertical section through a feed opening, and FIG. 21 shows a vertical section through a feed opening with inner container inserted and cap in place.

In the following description, like reference numerals are used for like parts or parts with like actions.

As shown in FIG. 1, the transport container comprises side walls 10, 10', a floor 11 and a top wall 12. The side walls 10, 10' are connected to one another by frame parts 20, which form vertical edges 9.

Within the interior of the transport container there can be received an inner container 8 made of plastic, the outlet valve 6 and feed opening 7 of which can be seen in FIG. 1 and are shown in detail in FIGS. 20, 21.

In the following, a first preferred embodiment is described.

The frame parts 20 in this embodiment can be opened by means of clamp devices 24 in such a way that the walls 10, 10' can be taken out of them after removal of the top wall 12 (or the floor 11). This procedure is described in detail below. In FIG. 2 a side wall 10 is shown in plan view. The floor 11 or the top wall 12 can be fabricated in the same way.

The side wall 10 bears grooves 16, 16' parallel to its edges 15 (FIG. 3), formed by indentation of face layers 13, 13' with simultaneous deformation of a honeycomb core 14 to which the face layers 13, 13' are bonded. As shown in FIG. 3, no material is removed to form the grooves, so that there is no appreciable change in thickness of the face layers 13, 13' and hence no appreciable stress concentration.

In the regions of the edges 15 the cells of the honeycomb core 14 are filled with artificial resin 17 so as to produce smooth edge surfaces.

At this juncture it should be noted that the size relationships in the drawings do not correspond to the actual relationships. In reality the cells are considerably smaller relative to the outer dimensions of a wall. Furthermore, as a rule several rows of cells at the edge are filled with artificial resin.

In the following, referring to FIGS. 5 to 9, embodiments of frame parts 20 will be discussed that serve in particular for the releasable connection of side walls. However, it should be pointed out expressly that the floor and the cover wall can be connected to the side walls in the same manner. It is a fundamental principle of the operation of the frame parts shown here that a frame part engages two walls in a form-fitting manner. For this purpose, the frame parts 20 comprise two sections, an inner frame part 22 and an outer frame part 23, which can be joined to one another by clamp devices 24. The inner frame part 22, like the outer frame part 23, comprises ridges 21, 21' that can engage the grooves 16 (FIGS. 2 and 3) in the walls 10.

Figure 5:
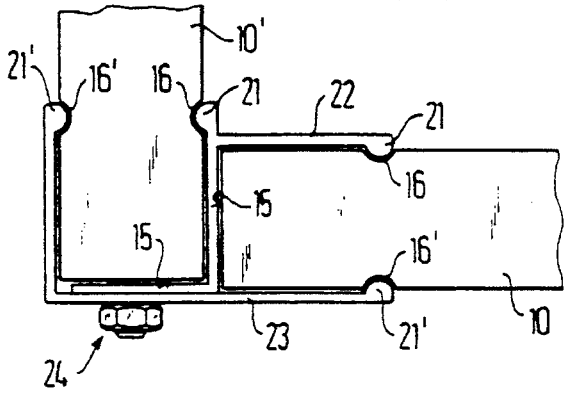

In the embodiment shown in FIG. 5, the inner frame part 22 is constructed in an approximately Z shape, whereas the outer frame part 23 is L-shaped. The inner frame part 22 is provided with an inwardly projecting ridge 21 at the free end of its flange and with another such in one corner region. The L-shaped outer frame part 23 has a ridge 21' at each of its free ends.

In the assembled state, i.e. when the outer frame part 23 is screwed to the inner frame part 22 in such a way that the free end of the inner frame part 22 that does not bear a ridge 21 extends into the inside corner of the outer frame part 23, the two frame parts 22, 23 form slotlike recesses bounded by the ridges 21, 21'. The edges of the walls 10, 10' are inserted into these slotlike recesses, whereupon the ridges 21, 21' engage the grooves 16. Given suitable dimensioning, in particular an inside angle of the outer frame part 23 of just under 90°, this engagement is maintained with high stability. Because the frame parts 20 hold the walls 10, 10' along substantially their entire length by engagement of the ridges 21 in the grooves 16, the connection is highly resistant to both pulling and bending forces. When the clamping device 24 is released, the opposed ridges 21, 21' can spread apart so that the walls 10, 10' can readily be taken out of the frame parts. In this way the transport container can very easily be disassembled.

In the embodiment of the invention shown in FIG. 6, the inner frame part 22 is constructed as a flat strip. The outer frame part 23 has substantially a C shape. The two frame parts 22, 23 are provided at their edges with the ridges 21, 21'.

Welded to the inner frame parts 22 at specified distances apart (along their length) are retaining bolts 26, the free ends of which extend outward through corresponding openings in the outer frame parts 23 and are provided with eyes to receive a tension lever 25. To increase the stability of the frame parts when the tension lever 25 is closed, spacer vanes 27 are provided that project outward from the inner frame parts, toward the outer frame parts. These spacer vanes also form an abutment for the edges 15 of the walls 10, 10', so that when the walls 10 are inserted between the two frame parts 22, 23 the ridges 21, 21' are correctly positioned over the grooves 16, 16'.

In the variant shown in FIG. 7, the inner frame part 22 is constructed in the form of a tube, so that there is no need for a special ridge 21 with corresponding formation of the groove 16. It is of course possible to make the radii of curvature of the ridges 21' on the outer frame parts 23 the same as the radius of the tubular inner frame part 22, so that the inner and outer sides of the walls 10, 10' are interchangeable.

In the further preferred embodiment of the invention shown in FIG. 8, the inner frame part 22 is made identical to the outer frame part 23. To accomplish this, ridges 21' and 21 are provided on each of the frame parts, the former curving outward and the latter inward, so that depending on whether the piece is being used as outer or as inner frame part, the outwardly curving or the inwardly curving ridges insert into the grooves 16, 16'. By this means, the costs of manufacture and storage are reduced and assembly is simplified.

The outer frame part 23 is connected to the inner frame part 22 by a screw 28, which can be screwed into a nut 29' fixedly disposed on the inner frame part 22. Because the inner frame part 22 has just the same configuration as the outer frame part 23, a nut 29 is also welded to the outer frame part 23. So that the two parts can be screwed together, the screw 28 is turned down in the region next to its head so as to prevent thread engagement here. This measure simultaneously ensures that the screw 28 is captively attached to the outer frame part 23. Furthermore, the inner frame part 22 is captively attached to the outer frame part 23, because to release the connection between the frame parts 20 and the walls 10, 10' the screw 28 need merely be loosened partially and not screwed completely out. To secure this captive attachment, a cotter pin or a retainer ring set into a groove can be provided at the end of the screw 28.

In the embodiment shown in FIG. 9 it is also indicated that the floor 11 can be constructed as a simple plate (e.g. a pallet). At the end of the outer frame part 23 there is additionally provided an outwardly projecting bracket 38 with a slot 37 by means of which the outer frame part 23 can be hooked under a bolt 36 projecting upward from the floor 11. A connection of the same kind is preferably also provided for the inner frame part 22, but for the sake of clarity this is not shown in FIGS. 8 and 9.

In the following, a method of manufacturing the walls (where appropriate, also the floor) is described with reference to FIGS. 10 and 11.

Firstly, honeycomb cores 14 are produced in a manner known per se; part of such a core is shown in plan view in FIG. 11. Slabs of the honeycomb material are placed on a conveyor belt (not shown here) with their edges in contact and are conveyed essentially continuously.

Onto both surfaces of the honeycomb core 14 are rolled an adhesive film 30, 30' and, above it, the face layers 13, 13'. This arrangement is then conveyed to heated rollers 31, 31', which heat the face layers 13, 13' and thereby melt and activate the adhesive films 30, 30'. At the same time, the heated rollers 31, 31' press the face layers 13, 13' firmly onto the honeycomb core 14. The arrangement is subsequently passed between cooled rollers 32, cooling it sufficiently that the adhesive hardens to its (final) solid state.

It is preferable here to use an adhesive filled with fibers of high tensile strength, which increases both the tensile strength of the material as a whole (and hence also its flexural strength) and its resistance to peeling. Furthermore, in a preferred embodiment of the invention not illustrated here, an additional layer of material incorporating fibers or webs to make it resistant both to traction and, in particular, to tearing is applied in order to ensure that the wall 10 will not be penetrated if struck by a sharp-edged or pointed object. Primarily, however, as explained above, this property is achieved by the damping characteristics of the honeycomb core, in that as honeycomb walls are crushed they effectively convert a sudden impact into energy of deformation.

In a further embodiment of the method in accordance with the invention, explained with reference to FIGS. 12 to 15, some of the cells of the honeycomb core are filled with artificial resin (e.g., after the lower adhesive film 30' and the lower face layer 13' have been applied), by way of narrow injection nozzles 33 at the edges of the honeycomb core 14 and an injection nozzle 34 extending at right angles to the transport direction (arrow in FIG. 12) of the honeycomb core 14. Here the nozzles 33 operate continuously as the honeycomb core 14 is being transported, whereas the nozzle 34 operates discontinuously. This operation is controlled by the valves shown in FIG. 12, which adjust the flow of artificial resin 17 from a resin reservoir 18. The resulting pattern is shown in FIG. 13, which represents the honeycomb core 14 in the region A of FIG. 12.

The honeycomb core thus filled in linear regions with artificial resin is then—as previously discussed—covered on its upper surface with an adhesive film 30 and a face layer 13, before the whole arrangement is passed through the heated rollers 31, 31' and the cooled rollers 32, 32' to finish the product. Then the grooves 16 are produced in the face layers 13, 13' by deforming the honeycomb core 14, the grooves aligned in the transport direction being impressed by narrow rollers and those perpendicular to the transport direction by, for example, a cylinder with one or more projecting ridges.

Finally, the object continuously produced in this way is cut (or sawn) into individual wall elements, the separation lines being positioned within the regions filled with artificial resin so that the cut edges are stable and smooth.

It is of course also possible to provide filled zones not only at the edges and perpendicular to them; depending on the dimensional requirements, additional filled zones oriented in the transport direction can be produced to match the dimensions of the walls to be manufactured. A plan view of such a wall with face layer 13 partially removed is shown in FIG. 14.

It is evident in the section shown in FIG. 15 that in the finished product the adhesive film 30 has fused, so that the face layers 13, 13' are closely apposed to the honeycomb core 14, with appreciable adhesive 30 remaining only in the corner regions between the walls of the cells and the face layer 13. If this adhesive 30 is filled with high-tensile-strength fibers, as described above, these regions serve to reinforce the material.

According to another embodiment of the manufacturing method, not illustrated here, the face layers 13, 13' are previously provided with a layer of thermoplastic adhesive, so that the separate step of applying an adhesive film 30, 30' can be eliminated.

In the following, another preferred embodiment of the invention is described with reference to FIGS. 16–19.

In this preferred embodiment of the invention, the frame parts 20 are constructed as extruded profiles in one piece, so that they cannot be taken apart. Furthermore, two different profiles are provided for the frame parts, namely a first profile for a cover frame part, as shown in FIG. 17, and a second profile for a frame part 20 to form a vertical edge 9, as shown in FIG. 18.

The cover frame parts 39 each comprise one pair of limbs with ridges 21, 21' and, at an angle of 90° to these, a second pair of limbs without such ridges. In the interior of the cover frame part 39 there is an integrally formed tubular element 41, the diameter of which is such that a standard thread for a screw 48 can be tapped into it. The walls intended to form the floor 11 or top wall 12 are provided with the described grooves 16 at all four edges 15, as shown on the right in FIG. 19.

Corner pieces 47 are also provided, each of which connects two cover frame parts 39. The floors 11 and cover walls 12 are assembled at the factory, by pushing cover frame parts 39 onto all four of their edges, in the direction of the ridges 21 or grooves 16. Then the corner pieces 47 are mounted by means of the screws 48, which are screwed into the threaded bores at the ends of the tubular elements 41 of the cover frame parts 39.

To assemble the whole transport container, tie bolts 40 (partially shown in FIG. 16) are first set into the end pieces 47 of the floor 11 so that they extend freely upward. Then the frame parts 20 are positioned by sliding their correspondingly dimensioned tubular elements 41 onto the tie bolts 40. Now a wall 10 is pushed between each two frame parts 20 in such a way that that the ridges 21 slide along the grooves 16 until the lower edges of the walls 10 are inserted between the limbs (without ridges 21) of the cover frame elements 30 of the floor 11. The next step is to set the cover wall onto the container, such that the upper edges of the side walls 10 in turn are inserted between the free limbs (without ridges) of the cover frame parts 39. Finally, nuts are placed onto the threads (not shown) of the tie bolts 40, which extend above the corner pieces 47 of the top wall 12, and are screwed tight.

In the following, the feed opening 7 is described with reference to FIGS. 20 and 21.

To form the feed opening 7 shown in FIG. 1, a cap seat 42 is embedded in the top wall 12. The cap seat is made of plastic and is provided with an inside thread, into which a cap 43 (see FIG. 21) can be screwed. When the cap 43 is screwed in, the opening 7 is tightly closed. In this case the transport container can be filled with bulk material, which then is sealed into the container by the cap 43.

If the transport container is to be used to transport liquids, an inner container 8 is used, comprising a liner 44 provided at its upper edge with a sealing ring 45. The liner 44 consists of a tough but easily deformable plastic sheet. The sealing ring 45 is also made of relatively soft material, which is relatively easily (elastically) deformable.

The procedure to insert the inner container 8 is as follows:

First the transport container is constructed until it is complete except for the top wall 12. Then the inner container 8 is placed inside, blown up with compressed air, and positioned so that it is seated essentially without folds in, or bulges out of, the transport container, which is still entirely open at the top. Now some air is let out so that the top wall 12 can be set onto the transport container and screwed down by the tie bolts 40. The sealing ring 45 (which has temporarily been closed) is pulled out through the cap seat 42, with some deformation of the ring, and is seated on the cap seat as shown in FIG. 21. Now the inner container 8 is ready to be filled. After filling the cap 43 is screwed on, so that it is seated firmly on the sealing ring 45 and thus closes the inner container 8 tightly.

It will be appreciated from the above description that various of the disclosed features can be combined with one another. However, it is an essential element of the invention that at least the side walls 10 are engaged in a form-fitting manner with the vertical frame parts 20, so that even hydrostatic pressure in the interior of the transport container does not cause the latter to burst apart.

| List of Reference Numerals |
|---|
| 6 Outlet valve |
| 7 Feed opening |
| 8 Inner container |
| 9 Vertical edge |
| 10 Wall |
| 11 Floor |
| 12 Spacer vane |
| 13 Face layer |
| 14 Honeycomb core |
| 15 Edge |
| 16 Groove |
| 17 Artificial resin |
| 18 Reservoir for artificial resin |
| 20 Frame part |
| 21 Ridge |
| 22 Inner frame part |
| 23 Outer frame part |
| 24 Clamp device |
| 25 Tension lever |
| 26 Retaining bolt |
| 27 Spacer vane |
| 28 Screw |
| 29 Nut |
| 30 Adhesive film |
| 31 Heating roller |
| 32 Cooling roller |
| 33 Longitudinal injection nozzle |
| 34 Transverse injection nozzle |
| 35 Supporting belt |
| 36 Bolt |
| 37 Slot |

-continued

| List of Reference Numerals |
|---|
| 38 Bracket |
| 39 Cover frame part |
| 40 Tie bolt |
| 41 Tubular element |
| 42 Cap seat |
| 43 Cap |
| 44 Liner |
| 45 Sealing ring |
| 46 Access opening |
| 47 Corner piece |
| 48 Screw |

I claim:

1. Transport container, in particular transport container in cuboid form, with walls (10, 12) at least on the sides and with a floor (11), wherein at least the walls (10) on the sides can be inserted by their edges (15) between limbs of frame parts (20), characterized in that the walls (10, 12) consist of sandwich panels comprising at least two outer face layers (13, 13') and a honeycomb core (14) connecting them, such that the cells of the honeycomb core extend perpendicular to the face layers (13, 13'), the walls (10, 12) include grooves (16, 16') recessed into the face layers (13) parallel to the edges (15), and that the frame parts (20) on the insides of their limbs bear ridges (21, 21') shaped to correspond to the grooves (16, 16') and are so constructed that the ridges (21, 21') can be brought into form-fitting engagement with the grooves (16, 16') and disengaged.

2. Transport container according to claim 1, characterized in that the grooves (16, 16') recessed into the two face layers (13, 13') are opposite one another.

3. Transport container according to claim 1, characterized in that the grooves (16, 16') are formed without the removal of material, by plastic deformation of the face layers (13, 13') and of the honeycomb core (14).

4. Transport container according to claim 1, characterized in that the frame parts (20) are so constructed that each frame part (20) connects two walls (10, 10') to one another and forms an edge (9) of the transport container.

5. Transport container according to claim 1, characterized in that the outer face layers (13, 13') and the honeycomb core (14) are made of aluminum.

6. Transport container according to claim 1, characterized in that the face layers (13, 13') in addition comprise a protective layer of material with high tensile strength, preferably fiber-filled artificial-resin material.

7. Transport container according to claim 1, characterized in that the cells of the honeycomb core (14) at the edges (15) of the walls (10, 12) are filled with artificial resin (17) or the like.

8. Transport container according to claim 1, characterized in that each frame part (20) connecting two walls (10, 10') to one another comprises an inner frame part (22) and an outer frame part (23) that can be clamped together by way of clamp devices (24) acting perpendicular to their long axes, in such a way that the walls (10, 10') are clamped by their edges (15) between the inner and the outer frame part (22, 23) with the ridges (21, 21') engaged in the grooves (16, 16), the inner frame part (22) preferably being captively joined to the outer frame part (23) and the clamp devices (24) preferably being constructed as fast-acting connectors comprising a tension lever (25) that can be operated without a tool.

9. Transport container according to claim 1, characterized in that the frame parts (20) are constructed as extruded profiles.

10. Transport container according to claim 9, characterized in that the frame parts (20) are formed in one piece and include tubular elements (41) extending in their long direction, to receive connecting devices (40, 48).

11. Transport container according to claim 1, characterized in that the floor (11) and a top wall (12) are provided with cover frame parts (39) that are connected to the adjoining walls (10) by way of limbs without ridges (21, 21').

12. Transport container according to claim 11, characterized in that the floor (11) and the top wall (12) are connected by means of tie bolts (40) that extend through the vertical frame parts (20), preferably through their tubular elements (41).

13. Transport container according to claim 1, characterized in that in a top wall (12) there is provided a feed opening (7) that can be tightly closed by screwing a cap (43) onto it.

14. Transport container according to claim 13, characterized in that the feed opening (7) is so constructed that a sealing ring (45) to form an access opening (46) of a leakproof inner container (8) can be set into the feed opening (7) and tightly closed by the cap (43).

15. Method of manufacturing a transport container according to claim 1 of aluminum, characterized by the following steps:

(a) a slab of honeycomb material is produced such that the cells extend perpendicular to the main surfaces of the slab; (b) to each of the main surfaces of the honeycomb slab a thermoplastic adhesive film in the form of a long sheet is applied; (c) face material in the form of a long sheet is then applied to the thermoplastic adhesive film on each surface; (d) the face-layer sheets are heated until the thermoplastic adhesive film softens and reaches its adhesive temperature; (e) the face-layer sheets are pressed onto the honeycomb core; (f) the face layers are cooled until the adhesive film has hardened and the face layers are bonded to the honeycomb core; (g) grooves are formed in the face layers parallel to their edges, preferably continuously by rolling or pressing.

16. Method according to claim 15, characterized in that in the steps (d) and/or (e) the heating and/or the pressing occur continuously, preferably by means of rollers or conveyor belts, and the steps (d) and (e) are preferably carried out simultaneously.

17. Method according to claim 15, characterized in that the slab of honeycomb material is filled with artificial resin in its edge regions, which are a specific number of cells wide.

18. Method according to claim 15, characterized in that the slab of honeycomb material is filled with an artificial resin in linear regions that are a specific number of cells wide, and that after step (f) the slab is separated into sections by cutting or sawing within the linear regions.

19. Method according to claim 1, characterized in that the filling with artificial resin occurs continuously before steps (b) and/or (c).

* * * * *

UNITED STATES PATENT AND TRADEMARK OFFICE

CERTIFICATE OF CORRECTION

PATENT NO. : 5,497,895

DATED : March 12, 1996

INVENTOR(S) : Michael Rudbach

It is certified that error appears in the above-indentified patent and that said Letters Patent is hereby corrected as shown below:

In the Claims: Col. 12, line 26 (claim 19), "claim 1" should be -- claim 15 --.

Signed and Sealed this

Thirteenth Day of August, 1996

*Attest:*

*Attesting Officer*

BRUCE LEHMAN

*Commissioner of Patents and Trademarks*